US006964359B1

(12) United States Patent
Darr et al.

(10) Patent No.: US 6,964,359 B1
(45) Date of Patent: Nov. 15, 2005

(54) PLASTIC CONTAINER

(75) Inventors: Richard C. Darr, Medina, OH (US); James C. Dorn, Norton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 38 days.

(21) Appl. No.: 10/873,039

(22) Filed: Jun. 22, 2004

(51) Int. Cl.[7] ..... B65D 5/72

(52) U.S. Cl. ..... 222/570; 222/571

(58) Field of Search ..... 222/570, 571

(56) References Cited

U.S. PATENT DOCUMENTS 5,597,090 A * 1/1997 Leahy ..... 222/571
6,209,762 B1 * 4/2001 Haffner et al. ..... 222/570

* cited by examiner

*Primary Examiner*—Philippe Derakshani
(74) *Attorney, Agent, or Firm*—Robert H. Bachman

(57) ABSTRACT

Plastic container having an upwardly extending finish provided with a dispensing opening, and a transition collar mounted on the finish, said collar having an upwardly projecting pouring spout. The upwardly extending finish of the container includes outwardly extending projections with spaces therebetween, wherein the projections engage the transition collar.

10 Claims, 2 Drawing Sheets

PLASTIC CONTAINER

BACKGROUND OF THE INVENTION

The present invention relates to an improved plastic container having an upwardly extending finish provided with a dispensing opening, and a transition collar mounted on said finish, said collar having an upwardly projecting pouring spout.

Considerable effort has been directed to packages for liquids including a container housing the liquid, a transition collar having a pouring spot mounted on the container outlet, and a measuring cup which serves as a closure for the container. For example, U.S. Pat. No. 4,550,862 shows a liquid product pouring and measuring package having a measuring cup which also serves as the closure for the package. The package includes a container including a container body with an upwardly extending finish and a dispensing orifice. A transition collar is mounted on the container finish and has a pouring spout and a circumscribing wall with fastening means on its interior surface. A measuring cup serves as a closure for the package and includes outwardly disposed fastening means adapted to mate with the inwardly facing fastening means on the transition collar to attach the measuring cup in the inverted position to the transition collar and thereby provide a closure for the package.

Locking teeth can be provided on the inner periphery of the transition collar to mate with locking teeth on the container finish so that the transition collar, when mounted on the container finish, will not rotate. However, a more secure engagement between the transition collar and the container finish can be provided by a glued engagement. The glued engagement provides a firm and rigid interlocking between the container finish and transition collar.

However, it would be desirable to provide an improved package including the container and transition collar with firm interlocking between these components. The improved package would include a measuring cup mounted onto the transition collar, wherein for example the resultant interlock between the container and collar will allow the measuring cup to be removed and replaced without causing rotation of the collar. This should desirably be accomplished with a glued, interlocked engagement and with a reasonable cost and with a minimum amount of glue.

It is therefore a principal object of the present invention to provide an improved package for liquids including a container for housing liquids and a transition collar having a pouring spout firmly mounted on the container finish.

It is a further object of the present invention to provide an improved package as aforesaid including a measuring cup mounted on the transition collar, wherein the measuring cup can be removed and replaced without causing rotation of the collar.

It is a still further object of the present invention to provide an improved package as aforesaid wherein the transition collar is glued onto the container with a minimal amount of glue, and to provide a firmly interlocked engagement between the container and transition collar.

Further objects and advantages of the present invention will appear hereinbelow.

SUMMARY OF THE INVENTION

In accordance with the present invention the foregoing objects and advantages are readily obtained.

The plastic container of the present invention comprises: a plastic container body for housing a liquid having an upwardly extending finish provided with a dispensing opening; a transition collar mounted on said finish, said collar having an upwardly projecting pouring spout and a circumscribing wall spaced from said pouring spout; wherein the upwardly extending finish of said container includes outwardly extending projections, preferably a plurality thereof, with spaces therebetween, and wherein the transition collar includes a downwardly extending flange with an inner surface thereof circumscribing said collar and opposed to said circumscribing wall, and wherein the inner surface of said downwardly extending flange engages the projections of the upwardly extending finish, with the outwardly extending projections contacting at least 25 percent of the inner surface of said downwardly extending flange, and with the spaces between said projections for adhesive to secure said transition collar to said container.

The circumscribing wall of the transition collar includes fastening means thereon formed on the interior surface of said circumscribing wall. A measuring cup is preferably provided adapted to serve as a closure, said measuring cup having an open mouth and fastening means on its external surface adapted to cooperate with said transition collar fastening means.

The outwardly extending projections, preferably six to fifteen thereof, are preferably spaced apart from each other around the periphery of the upwardly extending finish. Preferably also the inner surface of said downwardly extending flange includes a plurality of outward projections around the circumference thereof adapted to engage spaces between the outwardly extending projections of the upwardly extending finish.

Further features of the present invention will appear hereinbelow.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
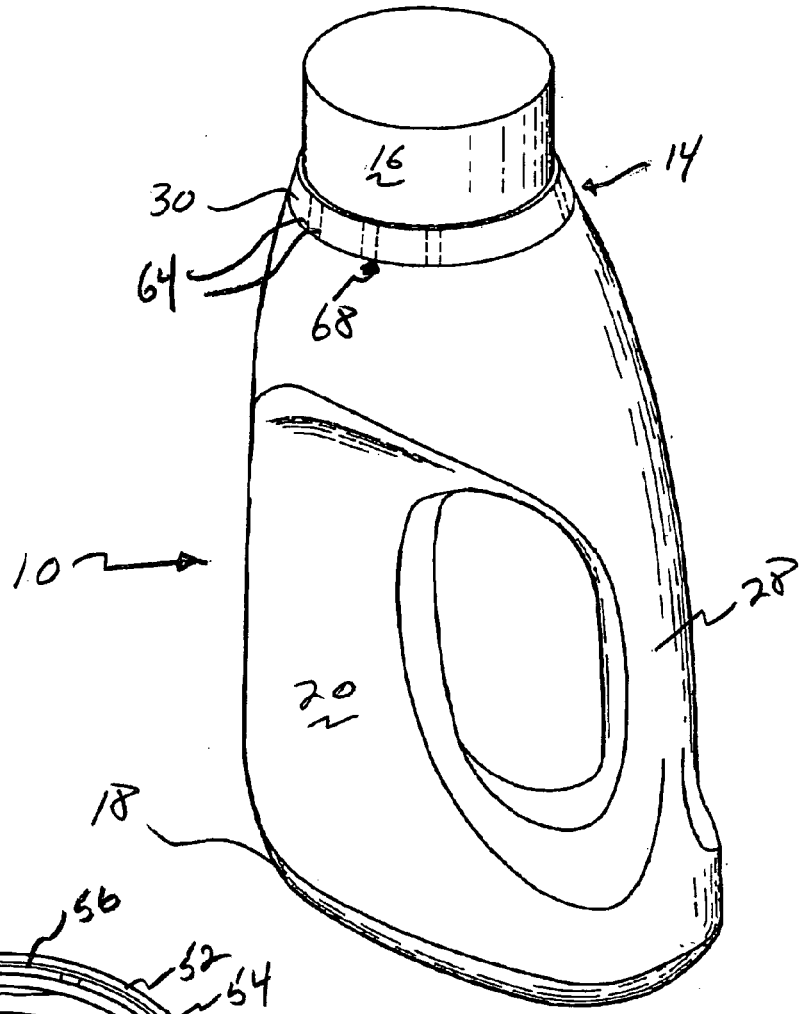
FIG. 1 is a perspective view of a container of the present invention with the components assembled together to form a closed container.
Figure 3:
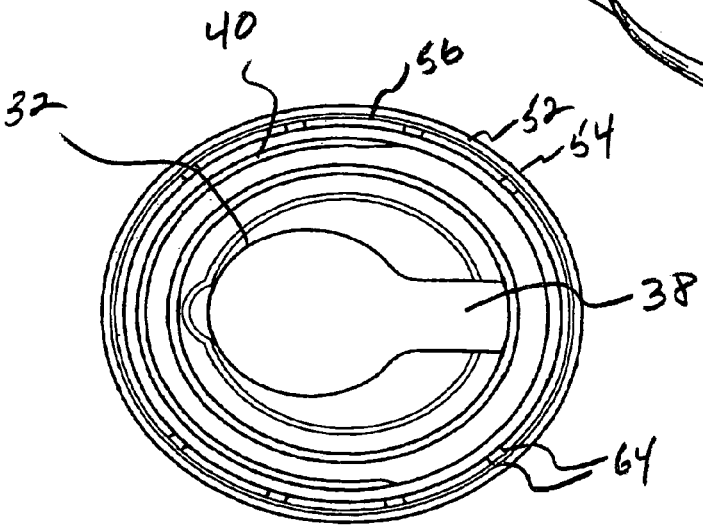
FIG. 3 is a bottom view of a transition collar of the present invention.
Figure 4:
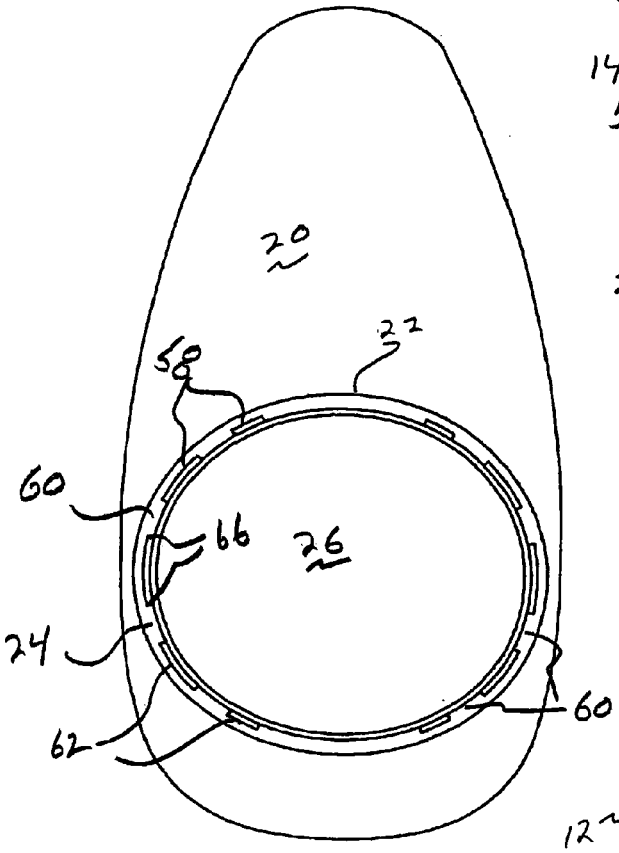
FIG. 4 is a top view of the container and the upwardly extending finish thereof.
Figure 2:
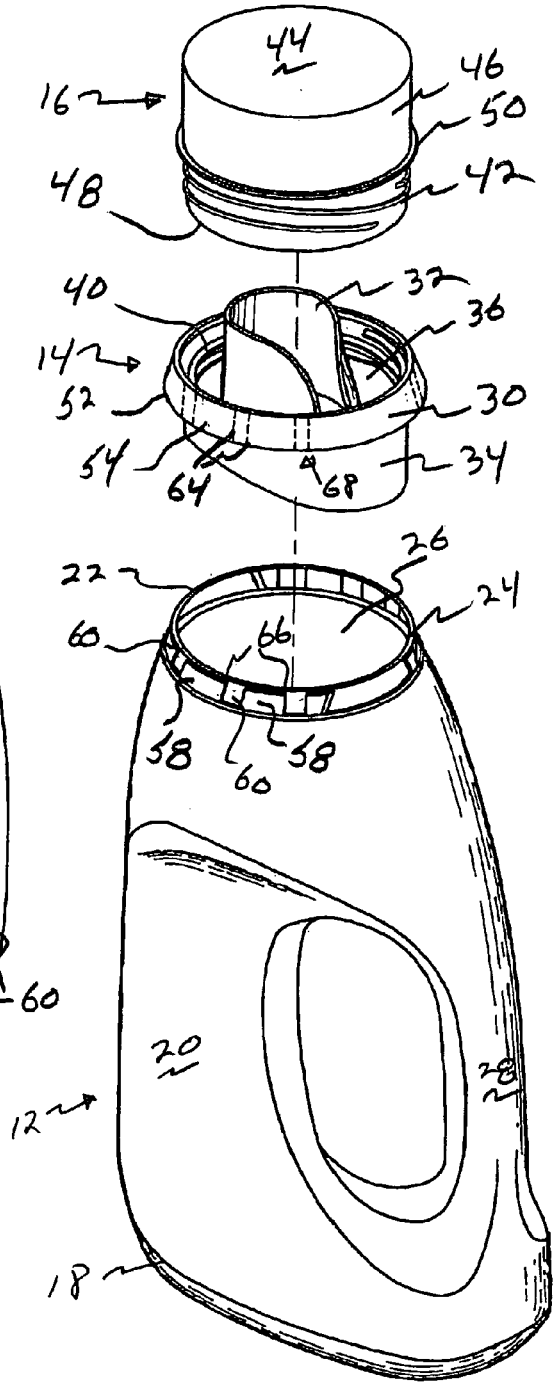
FIG. 2 is an exploded, perspective view of a container of the present invention including the container, transition collar and measuring cup spaced apart.

Referring to the drawings, FIGS. 1–4 represent the package of the present invention, with FIG. 1 showing the assembled package 10 and FIG. 2 showing an exploded, perspective view of the components thereof, namely container 12, transition collar 14 and measuring cup 16.

The container 12, which is typically constructed of a moldable plastic material such as polyethylene, polypropylene or polyethylene terephthalate, has a self-supporting base 18, body portion 20 extending upwardly from the base, and a finish 22 extending upwardly from the body portion. The finish 22 includes a flat annular lip 24 on the upper surface of the finish defining dispensing opening 26. The body portion provides a closed-end chamber suitable for containing the product to be dispensed. The body portion 20 desirably has an integrally molded handle 28 to provide a convenient gripping or holding means to facilitate dispensing and to properly orient the transition collar during pouring of the product.

Transition collar 14, which is typically injection molded of a thermoplastic material, such as polypropylene or the like, is preferably slightly harder than the material of either the container 12 or the measuring cup 16. This variance in hardness provides better sealing between the transition collar and the container and between the measuring cup and the transition collar.

Transition collar 14 has a continuous circumscribing outer wall portion 30 spaced from an upwardly projecting tubular pouring spout 32. A lower channel member 34 is provided beneath the circumscribing outer wall 30 to direct fluid to the pouring spout. An inclined drain back shoulder 36 is provided between the circumscribing outer wall portion 30 and pouring spout 32 with drain back opening 38 at the lower portion thereof which serves as both a vent and a drain. Fastening means, such as threads 40, on the transition collar on the interior or inside surface of circumscribing outer wall 30 (see FIGS. 2 and 3) which cooperate with fastening means, as threads 42 on the outside of measuring cup 16. As shown in FIG. 2, transition collar threads 40 are matched to measuring cup threads 42 so as to enable a firm connection between the measuring cup and transition collar as shown in FIG. 1.

The upwardly extending pouring spout 32 is coaxial with the transition collar 14. The diameter of the pouring spout should be sized for convenience in pouring the particular liquid involved, and the height of the pouring spout sized to fit within the inverted measuring cup 16 in the sealed position, the orientation of which is shown in FIG. 2.

Measuring cup 16 is generally cup-shaped with a bottom wall 44, a depending skirt-like sidewall 46 and an open mouth 48. The cup is typically injection molded of a fairly dense polymer, such as for example high density polyethylene, for compressive strength. A drip-prevention lip may be provided when the cup is used as a measuring cup, and also to provide an inner seal with the transition collar when the cup is used as a closure for the assembled package 10. Coaxial shoulder 50 is desirably provided above threads 42 when the cup is in the inverted position to provide a further sealing surface vis-à-vis the inside of the circumscribing outer wall 30 of the transition collar 14 when the cup is fastened to the collar as shown in FIG. 1.

In use for dispensing, cup 16 is removed from the package and liquid poured therefrom into the cup to the desired level. When the cup is filled to the desired level the liquid may be used as desired and the cup returned to its former position as a closure for the package.

In accordance with the present invention the transition collar 14 is mounted on the upwardly extending circumferential container finish 22 by a glued connection to provide a firm engagement therebetween. The transition collar circumscribing outer wall portion 30 includes a downwardly extending flange 52 circumscribing the collar with an outer surface 54 and an inner surface 56 thereof.

The outside surface of the upwardly extending container finish 22 includes a plurality of outwardly extending projections 58 with spaces 60 therebetween. Projections 58 are spaced apart from each other around the periphery of the upwardly extending container finish 22, with six to fifteen of said projections being provided. The projections are rectangular in shape with a flat outer surface 62 as clearly shown in FIG. 4. Moreover, the projections occupy at least 25 percent and preferably at least 40 percent of the outside surface of the upwardly extending container finish 22. When the transition collar 14 is mounted on the upwardly extending container finish 22 the inner surface 56 of the downwardly extending flange 52 engages projections 58 with flat surfaces 62 contacting at least 25 percent and preferably at least 40 percent of the inner surface 56 of the downwardly extending collar flange 52. Adhesive is applied to spaces 60 between projections 58. The contacting engagement of the projections flat surfaces 62 and inner surface 56 plus the glued connection provides a firm connection herebetween with the use of a minimal amount of glue due to the large amount of space occupied by the contacting relationship between the outwardly extending projections 58 and the inner surface 56.

Advantageously, the inner surface 56 of the downwardly extending flange 52 includes a plurality of outward projections 64 (outward from inner surface 56) around the circumference of the inner surface 56. The outward projections 64 are adapted to engage the spaces 60 between the outwardly extending projections 58 of the upwardly extending finish 22 and preferably engage the edges 66 of the outwardly extending projections 58 in order to secure the transition collar against movement. Desirably, the outward projections 64 comprise a plurality of pairs of spaced apart projections 68, with each pair of spaced apart projections being adapted to engage a space between the outwardly extending projections 58 and with each spaced apart projection 64 adapted to contact on edge 66 of the outwardly extending projections 58 so that the transition collar is secured against movement but a small amount of space is left therebetween for a glued interengagement between the transition collar and container finish. This advantageously provides a large amount of security against movement with a minimal amount glue.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container which comprises:

a plastic container body for housing a liquid having an upwardly extending finish provided with a dispensing opening;

a transition collar mounted on said finish, said collar having an upwardly projecting pouring spout and a circumscribing wall spaced from said pouring spout;

wherein the upwardly extending finish of said container includes outwardly extending projections with spaces therebetween, and wherein the transition collar includes a downwardly extending flange with an inner surface thereof circumscribing said collar and opposed to said circumscribing wall, and wherein the inner surface of said downwardly extending flange engages the projections of the upwardly extending finish, with the outwardly extending projections contacting at least 25 percent of the inner surface of said downwardly extending flange, and with the spaces between said projections for adhesive to secure said transition collar to said container.

2. A container according to claim 1, wherein the upwardly extending finish is a continuous circumferential finish, and the circumscribing wall spaced from the pouring spout is a continuous circumscribing wall.

3. A container according to claim 1, wherein the upwardly extending finish of said container includes a plurality of said outwardly extending projections spaced apart around the periphery of the upwardly extending finish.

4. A container according to claim 3, including six to fifteen of said outwardly extending projections.

5. A container according to claim 1, wherein the outwardly extending projections of said finish contact at least 40 percent of the inner surface of said downwardly extending flange.

6. A container according to claim 1, wherein the circumscribing wall of the transition collar includes fastening means thereon formed on the interior surface of said circumscribing wall.

7. A container according to claim 6, including a measuring cup adapted to serve as a closure for said container, said measuring cup having an open mouth and fastening means on its external surface adapted to cooperate with said transition collar fastening means.

8. A container according to claim 3, wherein the inner surface of said downwardly extending flange includes a plurality of outward projections around the circumference thereof adapted to engage spaces between the outwardly extending projections of the upwardly extending finish and to engage the outward edges of said outwardly extending projections.

9. A container according to claim 8, wherein said outward projections of the downwardly extending flange comprise a plurality of pairs of spaced apart projections, each pair of spaced apart projections being adapted to engage a space between the outwardly extending projections of the upwardly extending finish, with each spaced apart projection engaging an outward edge of the outwardly extending projections.

10. A container according to claim 8, wherein each of the outwardly extending projections of the upwardly extending finish is rectangular with a flat surface contacting the inner surface of said downwardly extending flange of the transition collar.

* * * * *